United States Patent [19]

Cameron

[11] Patent Number: 4,589,148

[45] Date of Patent: May 20, 1986

[54] TOILET HINGE

[75] Inventor: John T. Cameron, Howell, Mich.

[73] Assignee: Thetford Corporation, Ann Arbor, Mich.

[21] Appl. No.: 678,182

[22] Filed: Dec. 4, 1984

[51] Int. Cl.[4] ..... A47K 13/12

[52] U.S. Cl. ..... 4/236; 4/240; 16/257; 16/267

[58] Field of Search ..... 4/236, 240, 234, 237; 16/257, 259, 267, 262, 380

[56] References Cited

U.S. PATENT DOCUMENTS

| | | | |
|---|---|---|---|
| 534,018 | 2/1895 | Stevens, Jr. | 4/236 |
| 559,478 | 5/1896 | Bunting, Jr. | 4/236 |
| 2,221,991 | 11/1940 | Myers et al. | 4/240 |
| 3,829,905 | 8/1974 | Broek | 4/423 |
| 4,314,382 | 2/1982 | Ginsburg et al. | 4/236 |

FOREIGN PATENT DOCUMENTS

| | | | |
|---|---|---|---|
| 281385 | 6/1952 | Switzerland | 4/240 |

*Primary Examiner*—Stephen Marcus
*Assistant Examiner*—Linda J. Sholl
*Attorney, Agent, or Firm*—Stephenson & Boller

[57] ABSTRACT

A toilet hinge for hingedly mounting a seat and/or cover on a toilet bowl comprises a hinge part which includes resiliently yieldable fingers for cooperative engagement with the hinge pin. The hinge part contains a circular aperture having a circumferential extent greater than 180° but less than 360°, with the resiliently yieldable fingers extending from the aperture at a circumferential opening in the aperture. The resiliently yieldable fingers define a throat within which the hinge pin is received in response to downward loading applied to the seat and/or cover. The resilient yielding of the fingers allows the seat and/or cover to assume full support on the bowl rim so that the undesired stress levels in the parts, including the hinges, are avoided. When the downward load is removed, the resiliently yieldable fingers urge the hinge pin back into the aperture, thereby slightly elevating the rear of the seat and/or cover.

15 Claims, 8 Drawing Figures

TOILET HINGE

BACKGROUND AND SUMMARY OF THE INVENTION

This invention relates to a toilet hinge for hingedly mounting a seat and/or cover on a toilet bowl.

Toilets are usually provided with a seat and cover which are mounted by means of hinges to the toilet bowl. Typically, the seat underlies the cover. When the toilet is not in use, both cover and seat are typically positioned to close the top of the bowl. From the closed position, the cover may be swung open to make the seat available for use; if desired, the seat itself can also be swung open.

A typical hinge mounting comprises a pair of hinges laterally spaced apart adjacent the rear of the toilet bowl. One part of each hinge mounts to the bowl and is connected by means of a hinge pin with aligned apertured bosses in the seat and cover. Often, a pair of feet, or pads, on laterally opposite sides of the seat bottom provide points of contact at which the front of the seat bears against the front of the bowl when the seat is down.

If the seat does not bear against the bowl at other than the front set of feet when it is down, a downward load applied to the seat is reacted, by not only the front set of feet, but by the hinges as well. In order to avoid imposing a load on the hinges due to such a downward load applied to the seat, measures must be taken to insure that the seat has a further point of support, such as by a rear set of feet. In order to assure support by both front and rear sets of feet, more precise manufacturing and assembly procedures can be used, but they add to the cost of manufacturing the toilet. Alternatively, it is possible to increase the size and strength of the hinges, but this likewise increases the manufacturing cost.

When the hinges are subjected to reacting seat loads, a potential problem is that the hinges and the seat and/or cover may experience undesirable increases in stress levels. Moreover, depending upon the toilet construction, it is possible that stresses of an undesirable nature could be created in the bowl as well. A potential for increased stress levels applies to both cover and seat, depending upon particular design. In certain designs, the cover may rest upon the seat and not directly bear against the bowl, yet in others it may bear upon the bowl.

The present invention is directed to a novel and unique hinge construction for a toilet which is effective to allow the desired pivotal motion of the seat and/or cover with respect to the bowl, yet which is effective to compensate variations in fit of the seat and/or cover when subjected to load but without undersirable stress levels. In this way, variations in the fit of a seat and/or cover on a bowl in a mass-produced toilet will not, when the toilet is put to use, give rise to the creation of undesired stresses in the cover, seat, hinge and/or bowl which might otherwise occur to one or more of these parts. In other words, it essentially eliminates any need to adjust the seat and cover on the toilet bowl. Moreover, the invention is accomplished without the need to greatly increase the strength of the hinge, thereby conserving on the use of materials.

Briefly, if a seat and/or cover are in the down, or closed, position on the bowl, and a portion of a downward load is reacted by the hinges, the hinges are effective to allow relative motion between the seat and/or cover and the bowl occasioned by the downward load, and thereby permit the seat and/or cover to assume the full support on the bowl without undesired stress conditions in the hinges, or other parts as well. Moreover, the invention is accomplished in the preferred embodiment by the particular design of one of the hinge parts itself so that the use of separate additional parts is eliminated. The invention provides a cost-effective improvement for mass-produced toilets.

Also, depending upon the particular design of toilet, it may be important to control the rear edge of the cover in relation to a ledge on the top rear of the toilet bowl, as will be seen in the disclosed embodiment. An ancillary benefit of the invention is that this control between the rear edge of the cover and the ledge at the top rear of the bowl is also assured.

The foregoing features, advantages, and benefits of the invention, along with additional ones, will be seen in the ensuing description and claims, which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
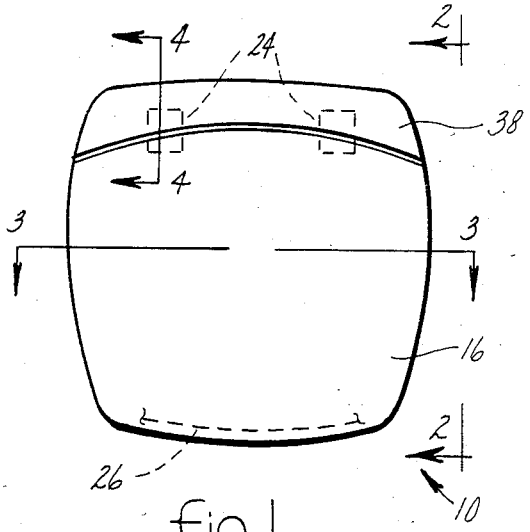
FIG. 1 is a top plan view of a toilet embodying principles of the present invention.
Figure 2:
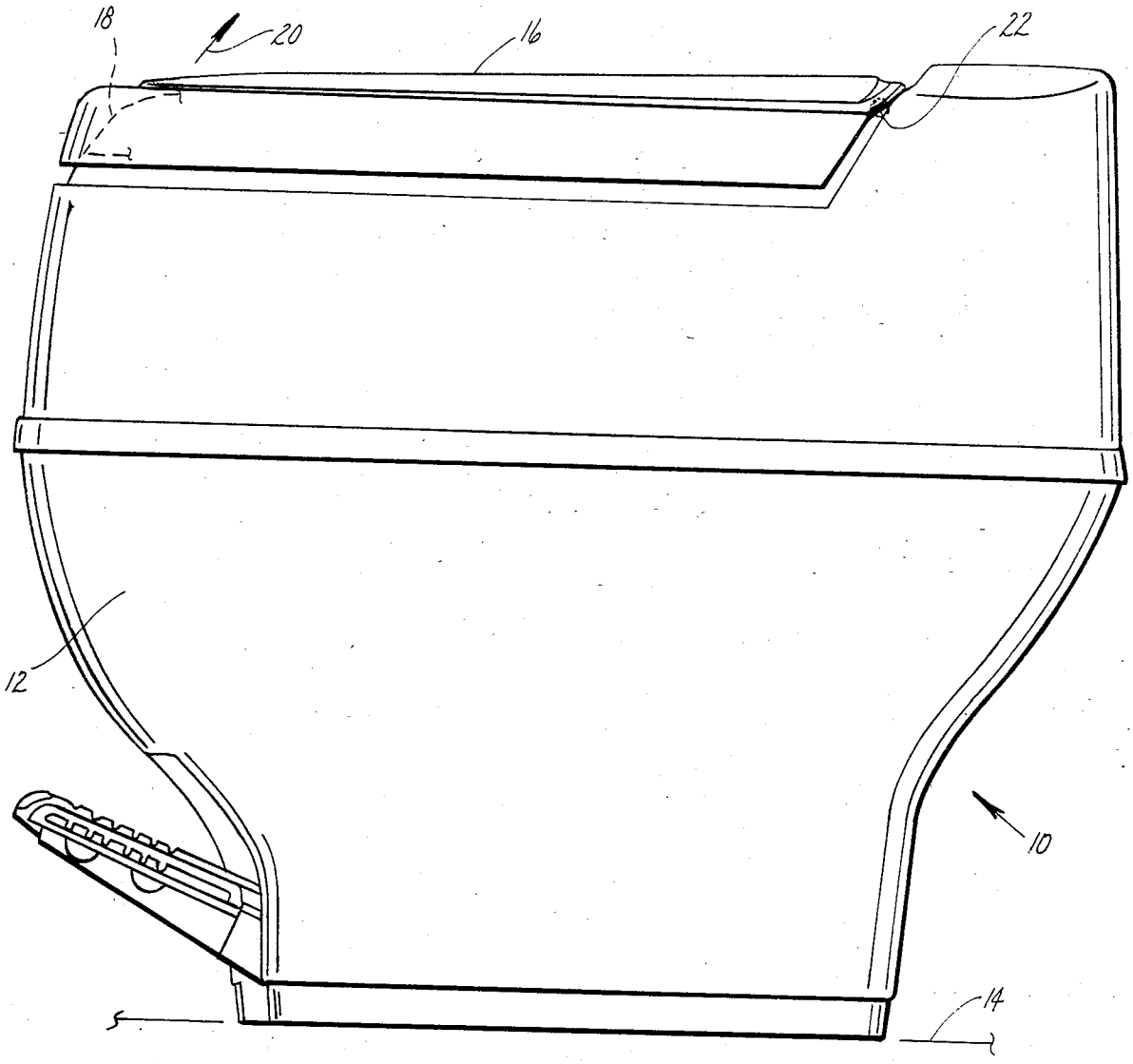
FIG. 2 is an enlarged side elevational view of the toilet of FIG. 1 taken in the direction of arrows 2—2.

FIGS. 1 and 2 illustrate a toilet 10 embodying principles of the present invention. Toilet 10 comprises a bowl 12 adapted for mounting on a horizontal surface 14 over a drain flange. A cover 16 and a seat 18 are cooperatively associated with bowl 12, FIGS. 1 and 2 illustrating the down, or closed, position of both.

In the down position, seat 18 is supported on the top of the bowl and cover 16 fits atop seat 18 to close the toilet. In use, cover 16 can be swung upwardly in the sense indicated by the arrow 20 about a hinge axis 22 at the rear of the bowl. This will open the bowl to make seat 18 available for use. With cover 16 open, seat 18 can also be swung upwardly in the same sense as indicated by arrow 20 about hinge axis 22.

The hinge mounting of the seat and cover on the bowl is provided by a pair of hinges, generally 24, indicated in FIG. 1. The detailed construction of these hinges will be explained in the ensuing description, since they contain principles of the invention.

Bowl 12 comprises a generally horizontal, generally flat, top rim 26. It is upon rim 26 that seat 18 bears when the seat is disposed in the down position, as shown in FIGS. 1 and 2. Desirably, seat 18 should bear on rim 26 in such a way that an occupant load on the seat is reacted at multiple bearing points between the seat and the bowl. For example, the underside of seat 18 can contain feet, or pads, 28 arranged in a particular pattern. There can be two pairs, one front and one rear, arranged in a generally rectangular pattern. The feet may be integral with the seat, or they may be separate parts attached to the seat. With all four feet in contact with the bowl, the occupant load is taken substantially by these four bearing points and transmitted directly to the bowl. In other words, the occupant load is not reacted in any significant way by hinges 24.

However, in order to achieve this four-point support, it is important for the axis about which hinging takes place to be accurately located. If the hinge axis is either too high or too low, less than all four of the feet will rest on the bowl rim. For example, if the hinge axis is too high, the front feet only will rest on the bowl rim, and if the axis is too low, only the rear feet will. In these circumstances, a load applied to the seat will be reacted not only by which-ever pair of feet are engaged with the bowl rim but also by hinges 24. Under such circumstances, appreciable loading of the hinges can take place and the seat itself may be subjected to undesirable stress levels. The same can apply for the cover, which in the illustrated toilet, bears against the seat rather than bearing directly against the bowl; in a design where the cover bore against the bowl, the same situation could apply to the cover.

It is possible to insure a four-point bearing of seat and/or cover on the bowl by taking appropriate measures in the manufacture and assembly of such toilets, involving various adjustments, and/or more precision parts; these measures, however, contribute to the cost of manufacture. It would also be possible to increase the strength of the hinges, but this too would add to cost.

The present invention is addressed to a new and unique hinge construction which: provides for a desired fit of the seat and/or cover on the bowl; does not require expensive manufacturing and assembly procedures which might otherwise be required to assure a suitable fit; and does so without the parts being subjected to undesired stress levels which might occur in the case of improper fit and without having to greatly increase the amount of material in the hinges in order to strengthen them.

Figure 4:
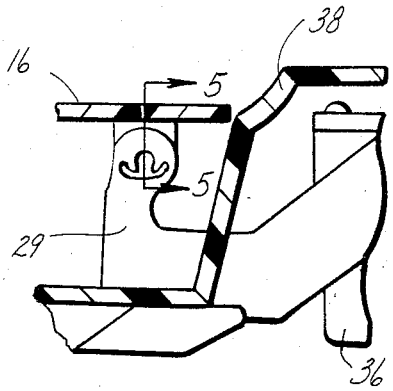
FIG. 4 is a fragmentary cross sectional view taken in the direction of arrows 4—4 in FIG. 1 and enlarged.
Figure 5:
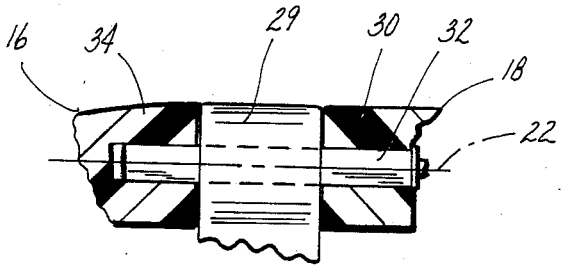
FIG. 5 is a fragmentary cross sectional view taken in the direction of arrows 5—5 in FIG. 4 and enlarged.
Figure 6:
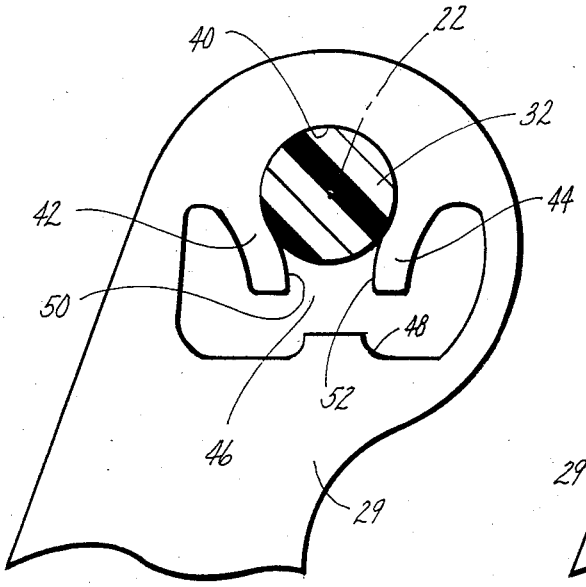
FIG. 6 is an enlarged view of a portion of FIG. 4.

FIGS. 4, 5, and 6 depict details of one of the hinges 24.

One hinge part is disposed in fixed relation to bowl 12 and is identified by the reference numeral 29. In the case of the hinge connection with seat 18, another part of the hinge is integrally formed with the seat and is identified by the reference numeral 30. As can be appreciated from consideration of the drawing figures, the hinge part 30 in each hinge is disposed inboard of the part 29. A hinge pin 32 forms the hinge connection between the two hinge parts 29 and 30 in each hinge 24, hinge part 30 having a 360° circular aperture engaged by hinge pin 32.

In the case of the hinge connection with cover 16, a hinge part 34 is formed integrally with the cover to form a cooperating hinge part having a 360° circular aperture which is engaged by the corresponding hinge pin 32.

As shown by FIGS. 4, 5, and 6, the hinge parts 29, 30 and 34 and the hinge pin 32 are shown to be co-axial with the hinge axis 22 when there is no load applied to the seat or cover.

The first hinge part 29 is shown to be a part of a vacuum breaker housing 36 of the type disclosed in issued U.S. Pat. No. 3,829,905, commonly assigned. Thus, two parts, 29, each of which forms a part of a corresponding one of the two hinges 24, extend from the sides of the vacuum breaker housing 36 which is located within the interior of a ledge 38 extending across the rear of the toilet bowl, there being suitable slots through which the parts 29 extend. FIG. 6 shows detail of the construction of the preferred embodiment of hinge part 29.

Hinge part 29 comprises a circular aperture 40 which is concentric with axis 22. As can be seen from FIG. 6, the diameter of aperture 40 is just slightly greater than the diameter of hinge pin 32 where the hinge pin passes through aperture 40. The circumferential extent of the illustrated aperture is just slightly less than $\frac{3}{4}$ of a circle in the toilet shown. In other words, the aperture has a circumferential extent greater than 180° but less than a full 360°. This leaves a circumferential opening which in the illustrated embodiment faces downwardly.

A pair of resiliently yieldable fingers 42 and 44 respectively extend from aperture 40 on opposite sides of the circumferential opening. The fingers 42 and 44 are formed integrally with hinge part 29 and cooperatively define between them a throat 46 which has a nominal diameter less than the diameter of hinge pin 32 where the hinge pin passes through aperture 40. The resiliently yieldable fingers 42 and 44 serve to resiliently urge hinge pin 32 upwardly toward aperture 40 and particularly in response to downward bodily displacement of the hinge pin due to downward loading applied to the seat and/or cover.

Figure 7:
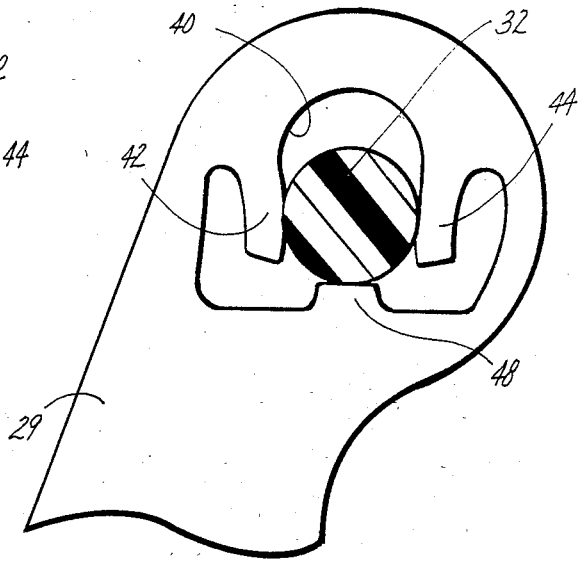
FIG. 7 is a view similar to FIG. 6 illustrating an alternate position of operation.

As can be appreciated from comparision of FIGS. 6 and 7, hinge pin 32 is relatively vertically positionable with respect to hinge part 29 within a range between the two positions illustrated by the respective FIGS. 6 and 7, FIG. 6 shows the position where the hinge pin is concentric with axis 22. FIG. 7 illustrates a position of maximum downward displacement of the hinge pin where the resiliently yieldable fingers, 42 and 44, are flexed laterally outwardly to expand throat 46. The maximum downward displacement of the hinge pin is limited by a limit stop 48 which is disposed directly below throat 56. As shown by FIG. 7, hinge pin 32 is in abutment with limit stop 48, and in this position, the resiliently flexed fingers 42 and 44 are continuing to exert an upward component of force on the hinge pin, urging it upwardly toward aperture 40. Hinge part 29 is constructed of any suitable material, for example, a plastic like polyethylene, so as to enable the fingers 42 and 44 to repeatedly resiliently flex between the positions, as represented by FIG. 6 and FIG. 7, over the service life of the toilet.

By designing the assembly of the various component parts of the toilet such that within the expected range of part tolerances, the seat is nominally slightly inclined downwardly toward the front of the bowl, the closed cover and seat have points of support at the front set of feet 28 and at hinges 24. If the cover and/or seat are now subjected to downward loading, as for example by an occupant load, a component of that load will be applied to the hinges, and this load is transmitted through each hinge pin. In turn, the downward force exerted by each hinge pin on the corresponding hinge part 29 will be reacted via the resilient yielding of fingers 42 and 44. Depending upon the magnitude of the component of loading applied through each hinge, there will be a corresponding amount of downward displacement of hinge pin 32 from aperture 40 which will be a function of the deflection characteristics of the of the resiliently yieldable fingers 42 and 44. The design characteristics are preferably such that before the full extent of downward travel of hinge pin 32 within the hinge part 29 has occurred, the rear set of feet 28 will have made contact with the top rim 26 of bowl 12, whereby the seat and/or cover will react most of the load via the four feet.

When the load is relieved, the fingers 42 and 44 will relax, urging the hinge pin upwardly back into aperture 40, and consequently, slightly elevating the seat and cover at the rear. Fingers 42 and 44 are designed to have respective curve surfaces 50 and 52 bearing against opposite sides of the hinge pin 32. The radii of curvature of these surfaces are located outwardly beyond the diameter of the aperture 40. The fingers may be considered to deflect in a generally cantilevered manner and to exert forces on the hinge pin from opposite sides.

Figure 8:
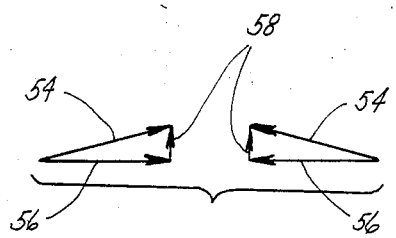
FIG. 8 is a diagram useful in explaining principles of the invention with reference to FIG. 7.

FIG. 8 illustrates a vector force diagram wherein the force exerted by each deflected finger is identified by the numeral 54. By making the fingers symmetrical about a vertical plane passing through axis 22, each finger will apply essentially the same force.

The force 54 may be resolved into a horizontal component 56 and a vertical component 58. The deflection characteristics of the fingers and the curvature of surfaces 50 and 52 are such that for all deflected positions, there are upward vertical components of force 58 urging the hinge pin upwardly.

Thus, the invention provides for the assembly of the various component parts without the need to make adjustments of the seat and/or cover on the bowl, and with assurances that neither hinges, seat nor cover, will be subjected to overloaded conditions due to occupancy loading.

Figure 3:
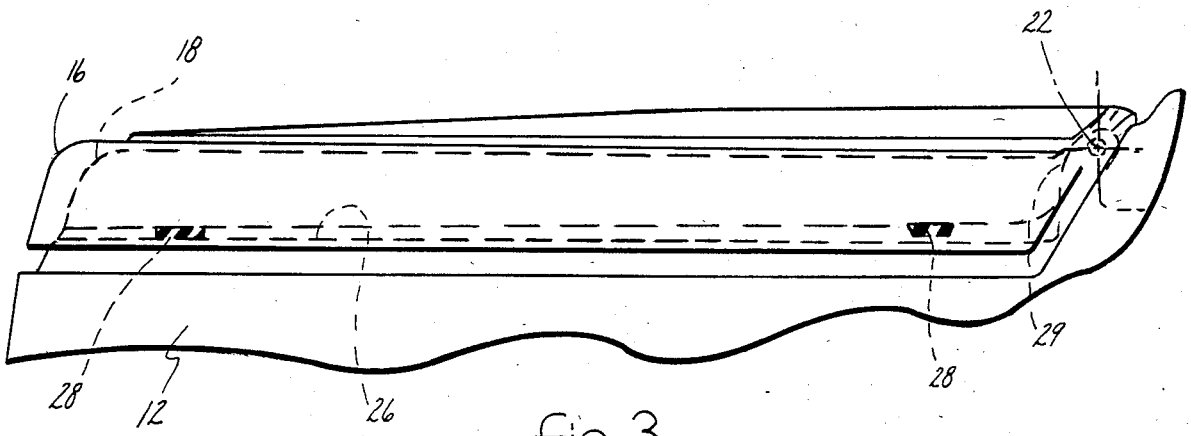
FIG. 3 is an enlarged view of the top portion of FIG. 2 looking from the same direction and showing further detail in phantom.

The invention also insures a more uniform appearance of the assembled toilet, since the nominal design can provide for the front of the seat and cover to be inclined very slightly downwardly. Thus, as shown by FIG. 3, the rear set of feet 28 is nominally spaced from rim 26 and will come into contact with the rim only in response to loading of the seat. While use of feet is desirable, it will be appreciated that the invention can be practiced without them.

It will also be appreciated that the invention has been embodied by merely changing the configuration of the hinge parts 29. In other words, in the previous design, hinge part 29 was provided with a 360° circular aperture through which the hinge pin 32 passed. Thus, the invention does not involve having to design heavier hinges in order to absorb the load forces which might be applied to the hinges due to variations in the fit of seat and/or cover on the bowl.

The construction also serves to locate the rear edge of the seat and cover in relation to ledge 38 so that free hinging action can take place without interference.

Thus, the invention provides a worthwhile cost-effective improvement in a toilet in which a cover and/or seat are hinged to the bowl.

While a preferred embodiment of the invention has been disclosed, it will be appreciated that principles are applicable to other embodiments.

What is claimed is:

1. In a toilet comprising a bowl with which at least one of a seat and cover is cooperatively associated by hinge means for selective operation between a generally horizontal position overlying the bowl and a second position different from the first-mentioned position, the improvement which comprises said at least one of said seat and cover having a bearing on the bowl at a location spaced horizontally from said hinge means and wherein said hinge means comprises a first hinge part on the bowl and a second hinge part on said at least one of said seat and cover and mean operatively coupling said first and second hinge parts to allow said at least one of said seat and cover to operate between said first-mentioned and said second positions and to resiliently yieldably allow limited vertical bodily displacement of the second hinge part relative to the first hinge part in response to downward loading of said at least one of said seat and cover so as to allow said at least one of said seat and cover to thereby assume a further bearing on the bowl when said at least one of said seat and cover is in the first-mentioned position, in which said means operatively coupling said first and second hinge parts includes a hinge pin between the first and second hinge parts, said means to resiliently yieldably allow limited vertical bodily displacement of the second hinge part relative to the first hinge part comprises a pair of fingers on opposite sides of the hinge pin, at least one of which is resiliently yieldable, integral with one of said hinge parts and having a operative engagement with the hinge pin, said one hinge part having an aperture which has a circular perimeter greater than 180° but less than 360° so as to leave a circumferential opening, said aperture having a diameter slightly greater than the diameter of the hinge pin and the hinge pin being disposed in essentially coaxial engagement with the aperture when said at least one of said seat and cover is not subjected to downward loading, and wherein said fingers extend from the circumferential opening of said aperture to form a throat having a nominal dimension which is less than the diameter of the hinge pin at the engagement thereof with the aperture, the dimension of said throat yieldably expanding in response to downward loading of said at least one of said seat and cover by said hinge pin being urged from said aperture and into engagement with said fingers in response to such downward loading, and said finger coacting on said hinge pin to urge the same back toward said aperture.

2. The improvement set forth in claim 1 in which said means to resiliently yieldably allow limited vertical bodily displacement of the second hinge part relative to the first hinge part comprises means to resiliently yieldably allow limited downward displacement of the second hinge part relative to the first hinge part.

3. The improvement set forth in claim 1 in which said means operatively coupling said first and second hinge parts comprises a hinge pin, an aperture in one of said hinge parts having a circular perimeter less than 360° for embracing said hinge pin and resiliently yieldable means urging said hinge pin toward said aperture, said resiliently yieldable means resiliently yielding in response to downward loading applied to said at least one of said seat and cover.

4. The improvement set forth in claim 1 including a limit stop cooperatively associated with said aperture and said fingers to limit the displacement of said hinge pin to a predetermined distance from said aperture such that the hinge pin, when displaced from the aperture continues to be urged back toward the aperture by the coaction of said fingers on said hinge pin.

5. The improvement set forth in claim 1 in which both said fingers are resiliently yieldable.

6. The improvement set forth in claim 5 in which said resiliently yieldable fingers comprise surface engaging the hinge pin which are curved about respective radii of curvature which are located radially outwardly beyond the diameter of said aperture.

7. The improvement set forth in claim 5 in which said resiliently yieldable fingers are symmetrically arranged with respect to each other about a plane passing through the axis of said aperture.

8. In a toilet comprising a bowl with which at least one of a seat and cover is cooperatively associated by hinge means for selective operation between a generally horizontal position overlying the bowl and a second position different from the first-mentioned position, the improvement which comprises said at least one of said seat and cover having a bearing on the bowl at a location spaced horizontally from said hinge means and wherein said hinge means comprises a first hinge part on the bowl and a second hinge part on said at least one of said seat and cover and means operatively coupling said first and second hinge parts to allow said at least one of said seat and cover to operate between said first-mentioned and said second positions and to resiliently yieldably allow limited vertical bodily displacement of the second hinge part relative to the first hinge part in response to downward loading of said at least one of said seat and cover so as to allow said at least one of said seat and cover to thereby assume a further bearing on the bowl when said at least one of said seat and cover is in the first-mentioned position, in which said means operatively coupling said first and second hinge parts includes a hinge pin between the first and second hinge parts which is displaced bodily with the second hinge part, said means to resiliently yieldably allow limited vertical bodily displacement of the second hinge part relative to the first hinge part comprises means integral with the first hinge part having an operative engagement with the hinge pin, said first hinge part comprises means forming an aperture having a circular perimeter greater than 180° but less than 360° so as to leave a circumferential opening, said aperture having a diameter slightly greater than the diameter of the hinge pin and the hinge pin being disposed in essentially coaxial engagement with the aperture when said at least one of said seat and cover is not subjected to downward loading, and wherein said means integral with the first hinge part comprises resilient yieldable means extending from the circumferential opening of said aperture to form a throat having a nominal dimension which is less than the diameter of the hinge pin at the engagement thereof with the aperture, said resilient yieldable means comprises means which resiliently yieldably expands the dimension of said throat in response to downward loading of said at least one of said seat and cover, said hinge pin being urged from said aperture and into engagement with said resilient yieldable means in response to such downward loading, and a limit stop cooperatively associated with said aperture and said resilient yieldable means to limit the displacement of said hinge pin to a predetermined distance from said aperture.

9. The improvement set forth in claim 8 in which said limit stop is so arranged in relation to said resilient yieldable means as to prevent the hinge pin from assuming a position with respect to said resilient yieldable means where said resilient yieldable means does not resiliently urge the hinge pin toward said aperture.

10. The improvement set forth in claim 9 in which said resilient yieldable means comprises a pair of resilient yieldable fingers on opposite sides of the hinge pin and extending from opposite sides of the aperture opening.

11. The improvement set forth in claim 10 in which said resilient yieldable fingers comprise surfaces engaging the hinge pin which are curved about respective radii of curvature which are located radially outwardly beyond the diameter of said aperture.

12. The improvement set forth in claim 10 in which said resilient yieldable fingers are symmetrically arranged with respect to each other about a plane passing through the axis of said aperture.

13. In a toilet comprising a bowl with which at least one of a seat and cover is cooperatively associated by hinge means for selective operation between a generally horizontal position overlying the bowl and a second position different from the first-mentioned position, the improvement which comprises said at least one of said seat and cover having a bearing on the bowl at a location spaced horizontally from said hinge means and wherein said hinge means comprises a first hinge part on the bowl and a second hinge part on said at least one of said seat and cover and means operatively coupling said first and second hinge parts to allow said at least one of said seat and cover to operate between said first-mentioned and said second positions and to resiliently yieldably allow limited vertical bodily displacement of the second hinge part relative to the first hinge part in response to downward loading of said at least one of said seat and cover so as to allow said at least one of said seat and cover to thereby assume a further bearing on the bowl when said at least one of said seat and cover is in the first-mentioned position, in which said means operatively coupling said first and second hinge parts comprises a hinge pin, an aperture in one of said hinge parts having a circular perimeter less than 360° for embracing said hinge pin and resiliently yieldable means urging said hinge pin toward said aperture, said resiliently yieldable means resiliently yielding in responce to downward loading applied to said at least one of said seat and cover, said resiliently yieldably means is integral with said one hinge part, said resiliently yieldable means comprises resiliently yieldably fingers disposed on opposite sides of said hinge pin and forming an expandable throat in which said hinge pin is received as said at least one of said seat and cover is subjected to downward loading, and a limit stop on said one hinge part cooperatively arranged with respect to said resiliently yieldable fingers such that the hinge pin is prevented from assuming a position where the resiliently yieldable fingers would not apply a force toward said aperture.

14. The improvement set forth in claim 13 in which said resiliently yieldable fingers comprise curved surfaces engaging the hinge pin, said curved surfaces having respective radii of curvature located in radially outwardly spaced relation to the diameter of said aperture.

15. In a toilet comprising a bowl with which at least one of a seat and cover is cooperatively associated by hinge means for selective operation between a generally horizontal position overlying the bowl and a second position different from the first-mentioned position, the improvement which comprises said at least one of said seat and cover having a bearing on the bowl at a location spaced horizontally from said hinge means and wherein said hinge means comprises a first hinge part on the bowl and a second hinge part on said at least one of said seat and cover and means operatively coupling said first and second hinge parts to allow said at least one of said seat and cover to operate between said first-mentioned and said second positions and to resiliently yieldably allow limited vertical bodily displacement of the second hinge part relative to the first hinge part in response to downward loading of said at least one of said seat and cover so as to allow said at least one of said seat and cover to thereby assume a further bearing on the bowl when said at least one of said seat and cover is in the first-mentioned position, in which said means operatively coupling said first and second hinge parts comprises a hinge pin coupling said first and second hinge parts, said hinge pin having cooperative engagement with apertures in both said seat and cover, and resiliently yieldable means on one of said hinge parts to allow the hinge pin and said seat and cover to be displaced bodily downwardly with respect to the first part in response to downward loading applied to the seat and cover, and in which said one part comprises means defining an aperture having a circular perimeter greater than 180° but less than 360° with said circular perimeter having a diameter slightly greater than the diameter of the hinge pin so that the hinge pin is essentially coaxial within the aperture when the seat and cover are not subjected to downward loading, and including a pair of resiliently yieldable fingers integral with and extending from said one part at circumferential ends of said aperture to form a throat within which the hinge pin is received in response to downward loading applied to the seat and cover, said fingers having curved surfaces with respective radii of curvature located in radially outwardly-spaced relation to the perimeter of said aperture arranged to resiliently urge the hinge pin and the seat and cover vertically upwardly in response to such loading, and a stop disposed integral with said one part in cooperative association with said pair of resiliently yieldable fingers to prevent said hinge pin from assuming a position where the resiliently yieldable fingers would not exert a force on the hinge pin urging it toward said aperture.

* * * * *